US005667370A

United States Patent [19]

Im

[11] Patent Number: 5,667,370

[45] Date of Patent: Sep. 16, 1997

[54] SCREW VACUUM PUMP HAVING A DECREASING PITCH FOR THE SCREW MEMBERS

[75] Inventor: Kisu Im, Pusan, Rep. of Korea

[73] Assignee: Kowel Precision Co., Ltd., Pusan, Rep. of Korea

[21] Appl. No.: 517,631

[22] Filed: Aug. 22, 1995

[30] Foreign Application Priority Data

Aug. 22, 1994 [KR] Rep. of Korea ..... 94-20662

[51] Int. Cl.[6] ..... F04C 18/16; F04C 25/02

[52] U.S. Cl. ..... 418/9; 418/150; 418/201.1

[58] Field of Search ..... 418/9, 150, 201.1, 418/201.3

[56] References Cited

U.S. PATENT DOCUMENTS

| | | | |
|---|---|---|---|
| 2,691,482 | 10/1954 | Ungar | 418/9 |
| 2,705,922 | 4/1955 | Rathman | 418/201.1 |
| 3,424,373 | 1/1969 | Gardner | 418/201.1 |
| 3,807,911 | 4/1974 | Caffrey | 418/201.1 |
| 4,224,015 | 9/1980 | Nagata | 418/201.3 |
| 4,714,418 | 12/1987 | Matsubara et al. | 418/201.1 |

FOREIGN PATENT DOCUMENTS

| | | | |
|---|---|---|---|
| 596122 | 12/1947 | United Kingdom | 418/201.1 |

*Primary Examiner*—John J. Vrablik

*Attorney, Agent, or Firm*—Birch, Stewart, Kolasch & Birch, LLP

[57] ABSTRACT

A screw displacement pump has a chamber. Inlet and outlet are provided for the admission of gas to and discharge of gas from the chamber. Intermeshing screw members rotatably mounted within the chamber for delivering the gas from the inlet to outlet, wherein the pitch of the screw members decrease continuoulsy from the inlet end thereof to the outlet end thereof to cause compression of the gas being delivered. The continuous reduction in the pitch distance from the inlet end to the outlet end is generated by the following relationship:

$$\text{Pitch at the outlet end/Pitch at the inlet end} < \pi_t/k$$

where, $\pi_t$=pressure ratio calculated under the condition that the process is effected in a adiabatic and the work done is constant, $C_1=0$, and k is gas constant.

2 Claims, 4 Drawing Sheets

SCREW VACUUM PUMP HAVING A DECREASING PITCH FOR THE SCREW MEMBERS

BACKGROUND OF THE INVENTION

1. Field of the Invention

The present invention relates to a screw vacuum pump, and more particulary a positive displacement screw vacuum pump which is designed to have a single stage screw rotor and to reduce the power consumed in a high vacuum range.

2. Description of the Prior Art

Vacuum pumps are widely used in various industries, such as semiconductor manufacturing industry, metallurgical industry, chemical industry, and the like.

As a known vacuum pump, there exists a water sealed vacuum pump, a Root's type vacuum pump, a screw type vacuum pump and an ejector type vacuum pump, for example.

In the water sealed vacuum pump, foreign matter is led from a suction opening to a discharge opening under the condition where it directly contacts with water during obtaining vacuum. Therefore, the water sealed vacuum pump cannot successfuly be used in the refining industries such as, semiconductor manufacturing industry, pharmaceutical products industry and the like, which cannot have the ingression of impurities. Accordingly, a dry type or water free type vacuum pump has been used to ensure that the gas to be vacuumized is not in contact with the water.

However, although this type of vacuum pump is employable in a medium vacuum range, it is not suitable for use in a low vacuum range (less than 400 Tort) because the leakage of gas from between the rotors increases to remarkably raise the gas temperature, which results in burning of the rotors.

To solve the drawback of the water free type vacuum pump, a multi-stage screw vacuum pump has been suggested to avoid generation of heat and thus burning of the rotors. Although this multi-stage screw vacuum pump is suitable fox use over a low vacuum range to a high vacuum range, it has some disadvantages that the device is not simplified, the cost increased and the space required for a given pump capacity is increased.

Referring to FIG. 6 which shows a conventional Root's type multi-stage vacuum pump. The pump housing has formed therein three chambers seperated by partitions. A pair of shafts 20 within the chambers are mounted thereon three rotors, i.e., a first stage rotor 21, a second stage rotor 22, and a third stage rotor 23 respectively. These rotors have widths which is decreased with a geometrical ratio. The pump housing has formed therein a first stage inlet port 24, a second stage inlet port 26 and a third stage inlet port 28 at one side of the housing. On the opposite side of the housing, a first stage outlet port 25, a second stage outlet port 27 and a third stage outlet port 29, each communicating with the corresponding inlet port. The assembly is simplified and the space requirement has been reduced by using the unified screw rotors.

One disadvantage encountered with the Root's type multi-stage vacuum pump, howerever, is that they tend to experience significant reduction in pumping efficiency. For this reason, the use of the Root's type multi-stage vacuum pump is greatly limited.

There exists, therefore, a significant need for an improved vacuum pump capable of providing an efficient pumping performance at a relatively high pressure.

FIG. 7 shows multi-stage screw type vacuum pump, Japanese Patent Laid-Open 63-36086, which has been proposed to meet the above mentioned demands. The casing includes a rotor chamber having first suction opening 37 and first discharge opening 38 (encircled by alternate long and two short dashed lines respectively) and second suction opening 39 and second discharge opening 40 (encircled by broken line respectively), and a first pair of male 32 and female screw rotor 33 meshing with each other which are rotatably received in the rotor chamber, a second pair of male 34 and female screw rotor 35, the pitch $P_2$ of these screw rotors being shorter than the pitch $P_1$ of the first pair of screw rotors 32 and 33. All of the threaded portions of the screw rotors have a shape of an arc 50, Archimedean curve 51 and epitrochoid 52.

However, the screws of said Japanese Patent Laid-Open 63-36086 have a constant pitch such that there is no tendency to compress the gas along the length of the screw and therefore it is unsuitable for applying it in a relatively high vacuum range. Moreover, the pump has double stage screw rotors so that the assembly is complicated, space requirements increased, and the cost increased.

Thus, a single stage oil free type vacuum pump suitable for use over a low vacuum range to a high vacuum range has been required.

The present invention fulfills these needs and provides further related advantages.

SUMMARY OF THE INVENTION

It is an object of the present invention to provide a screw vacuum pump which may obtain a wide vacuum range with a great efficiency with use of a single stage screw rotor.

It is a further object of the present invention to provide screw vacuum pump which may reduce the power consumed as compared to a conventional screw displacement pump.

It is a still further object of the present invention to provide a screw vacuum pump which may be fabricated with a reduced number of components, thus reducing the space requirement.

According to the present invention, there is provided a screw displacement pump comprising a body defining a chamber, at least one inlet and at least one outlet for the admission of gas to and discharge of gas from the chamber, and a pair of intermeshing screw members rotatably mounted within the chamber for transporting the gas from the inlet to outlet, wherein the pitch of the screw members decrease from the inlet end thereof to the outlet end thereof to cause compression of the gas being delivered.

Other objects and features of the invention will be more fully understood from the following detailed description and appended claims when taken with the accompanying drawings.

DETAILED DESCRIPTION OF THE PREFERRED EMBODIMENT

Figure 1:
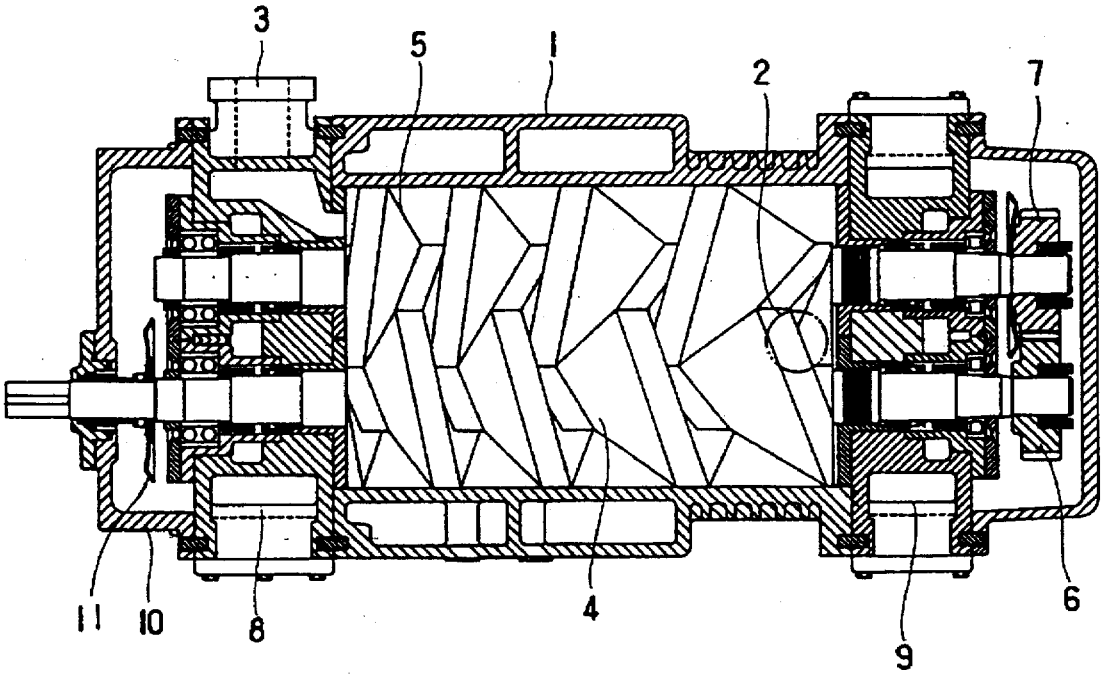
FIG. 1 is a transverse sectional view of the screw vacuum pump according to the present invention.
Figure 2:
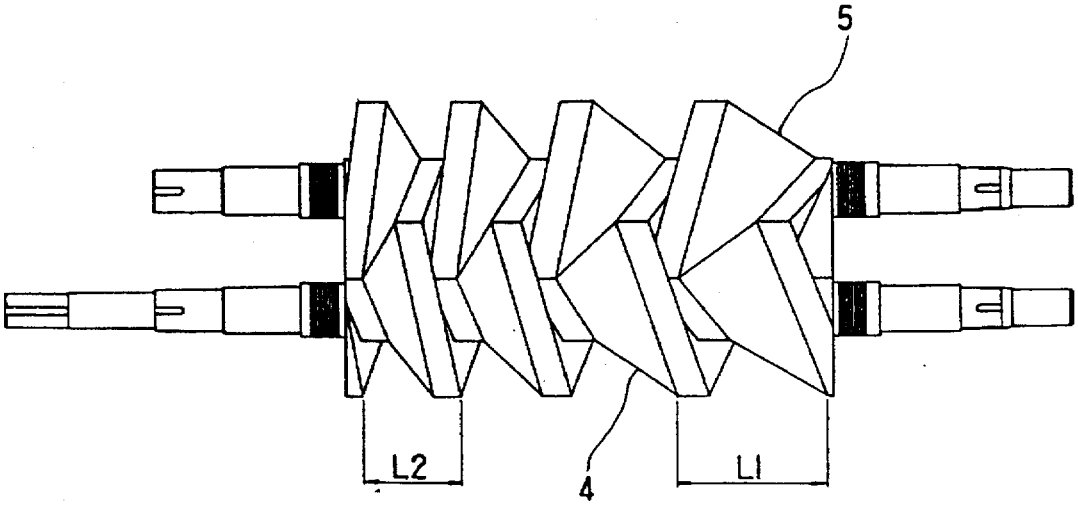
FIG. 2 is an elevational view of the rotor of the screw vacuum pump according to the present invention.
Figure 3:
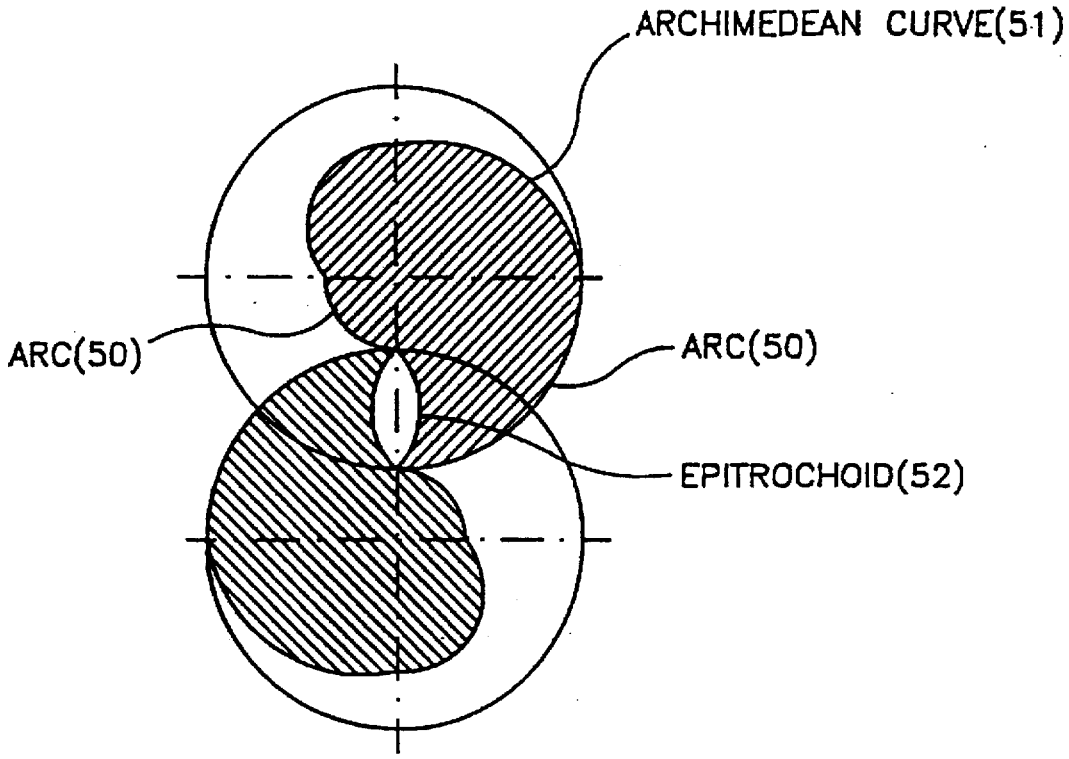
FIG. 3 shows an axial view of the threaded portion of the rotor, as utilized in the invention.

Referring now to FIG. 1 and 2 which show a single stage screw vacuum pump and rotor 4 and 5 of the present invention, reference numeral 1 generally designates a casing which includes components comprising the pump.

The casing 1 includes at one end thereof an inlet opening 2 (encircled by alternate long and two short dashed lines) communicated with a provision to be vacuumized to suck the gas through the inlet opening 2, and at other end of the casing 1 an outlet opening 3 to discharge the sucked gas to outside of the pump. Within the casing 1 are mounted two screw rotors 4 and 5 arranged to be intermeshed with substantially zero internal operating clearance and permit the flow of the gas along the screw rotors 4 and 5 each rotor includes a plurality of teeth having a shape of an epitrochoid and archimedean curve.

The pitch of the screw may vary along the length of the screws, or alternatively the pitch of the screws may decrease from the inlet end thereof to the outlet end thereof.

The screw rotors 4 and 5 are rotatably mounted in timing gear 6 and 7 on one end thereof intermeshed to ensure that the screw rotor 4 and 5 rotate at the same speed in opposite directions.

In normal operation of the pump to deliver fluid from an inlet port to an outlet port formed in the casing, the drive rotor 4 is rotatable driven from suitable motor (not shown), and the driven rotor 5 also rotated at the same revolution speed through timing gears 6 and 7 which ensure that the screw rotors 4 and 5 rotate at the same revoltion speed.

As shown In FIG. 2, since each screw rotor 4 and 5 have a continuous change of pitch along its length, the gas pumped can be compressed at the transition between three threaded portions of the screw rotors 4 and 5. The pitch of the screw rotors 4 and 5 could be reduced continuously along the screw rotors 4 and 5.

Therefore, a desired compression ratio can be attainable with the improved single stage screw vacuum pump of the present invention.

Reference numerals 8 and 9, which are not described in detail, designate both end plates supporting the screw rotors 4 and 5. Reference numeral 10 is an end cover in which a lubricating oil is reserved, and reference numeral 11 is an oil splasher for supplying the lubricating oil to a bearing.

As above described, the pump according to the present invention has an advantage that it effects volume change (compression) of gas sucked during passage along the screw rotor. The volume change of the gas, i.e., volume ratio $V_i$, may expressed as follows:

$$V_i = \frac{V_1}{V_2}$$

where, $V_1$ is a volume of the gas at the inlet end, and $V_2$ is a volume of the gas just before discharging to the outlet opening.

As changing of the volume of the sucked gas, it is clear that a change in the pressure of the gas delivered within the casing can also take place. If the change of pressure, called pressure ratio $\pi_i$, within the casing take place under the adibatic process, the pressure ratio $\pi_i$ may be expressed as follows:

$$\pi_i = k \cdot V_i$$

where, k is a gas contant.

Figure 4:
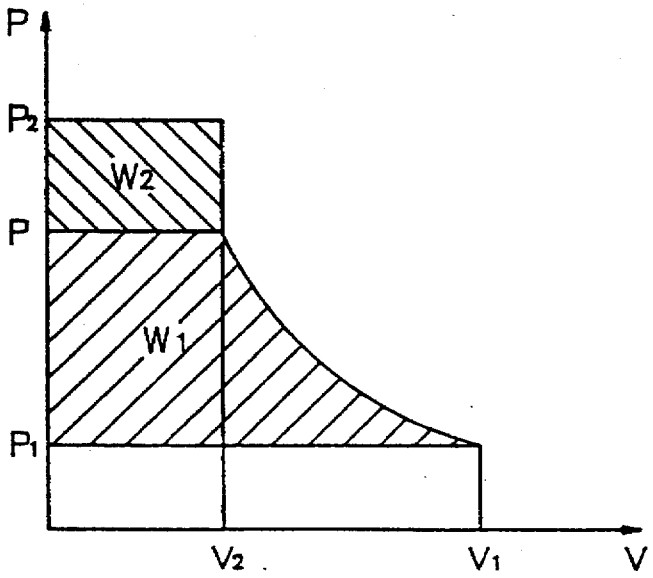
FIG. 4 is a pressure/volume diagram for the pump according to the present invention.

The pressure/volume diagram of FIG. 4 shows a work done by the pump system which is expressed as the area of the slanted lines $W_1$ and $W_2$. Thus, the total work N done by the pump system may be determined by the equation:

$$N = W_1 + W_2$$

or $$N = \int_{P_1}^{P_i} VdP + \int_{P_i}^{P_2} VdP$$

Since $W_1$ and $W_2$ can be determined by the following equations:

$$W_1 = \frac{k}{k-1} \cdot P_1 \cdot V_1 (\pi i^{(k-1)/k} - 1)$$

and $$W_2 = \left( \frac{V_1}{\pi i^{1/k}} \cdot P_2 \right) - (P_1 \cdot V_1 \cdot \pi i^{(k-1)/k})$$

the total work N done by the pump system can be rewritten as $$N = V_1 \left( \frac{\pi i^{(k-1)/k} - k}{k-1} \right) \cdot P_1 + \frac{V_1}{\pi i^{1/k}} \cdot P_2$$

where, since $P_2$ is to be contant as an atmospheric pressure, the equation can be expressed as follows:

$$N = C_1 \cdot P_1 + C_2$$

Realizing that the $C_1$ and $C_2$ are constant, the condition in which the total work done is always constant can be expressed as $C_1=0$. Accordingly, the following equation can be obtained.

$$\pi_i^{(k-1)/k} - k32\ 0$$

or $$\pi_i = k^{k/(k-1)}$$

Assuming that the gas to be pumped is air, then k=1.4 and $\pi_i=3.2$.

Figure 5:
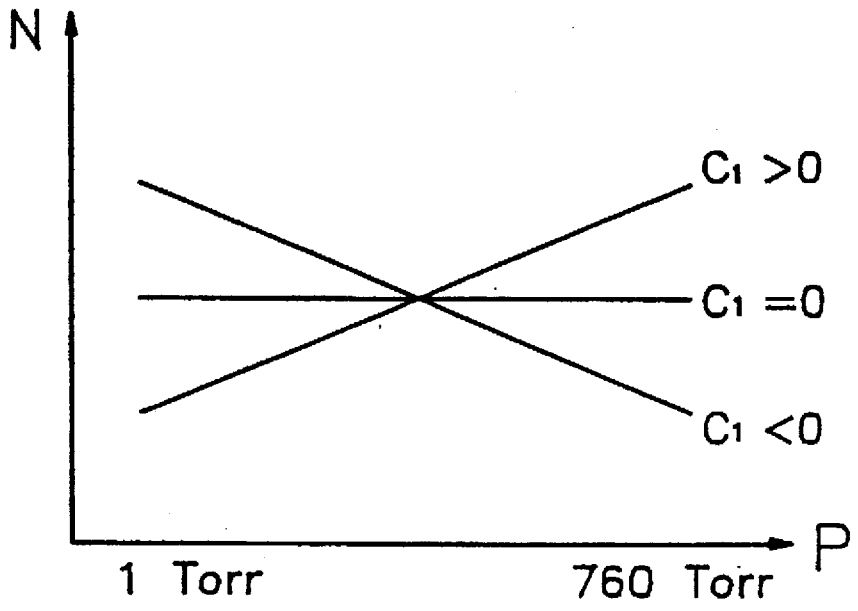
FIG. 5 is a work/pressure diagram for the pump according to the present invention.
Figure 6:
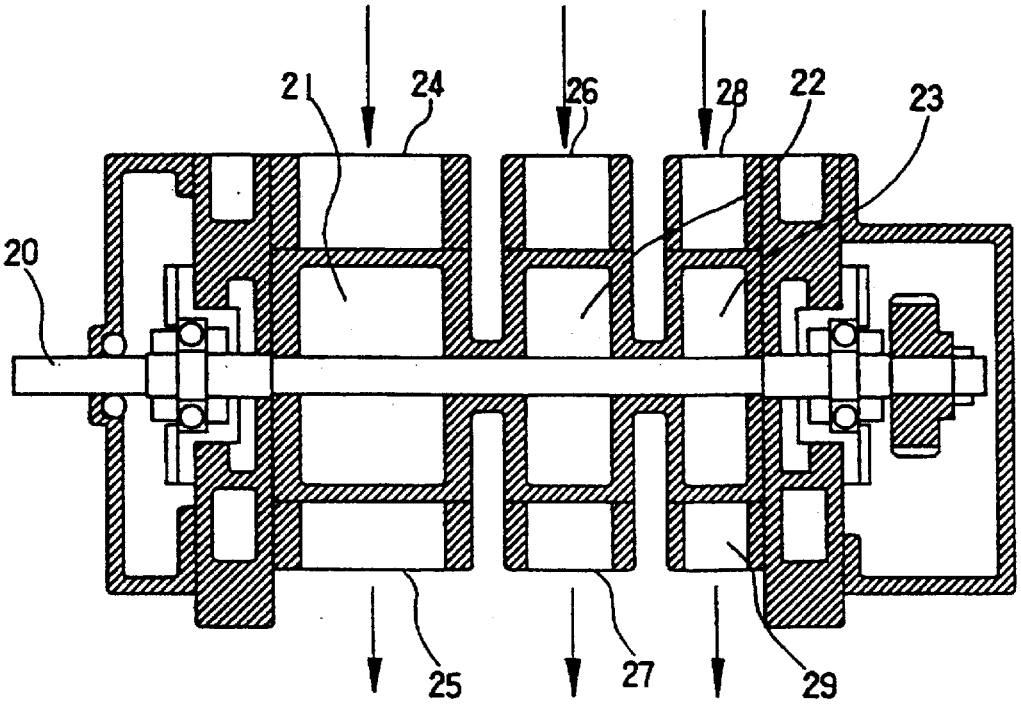
FIG6 (PRIOR ART)
FIG. 6 is a transverse sectional view of a conventional Root's type vacuum pump.
Figure 7:
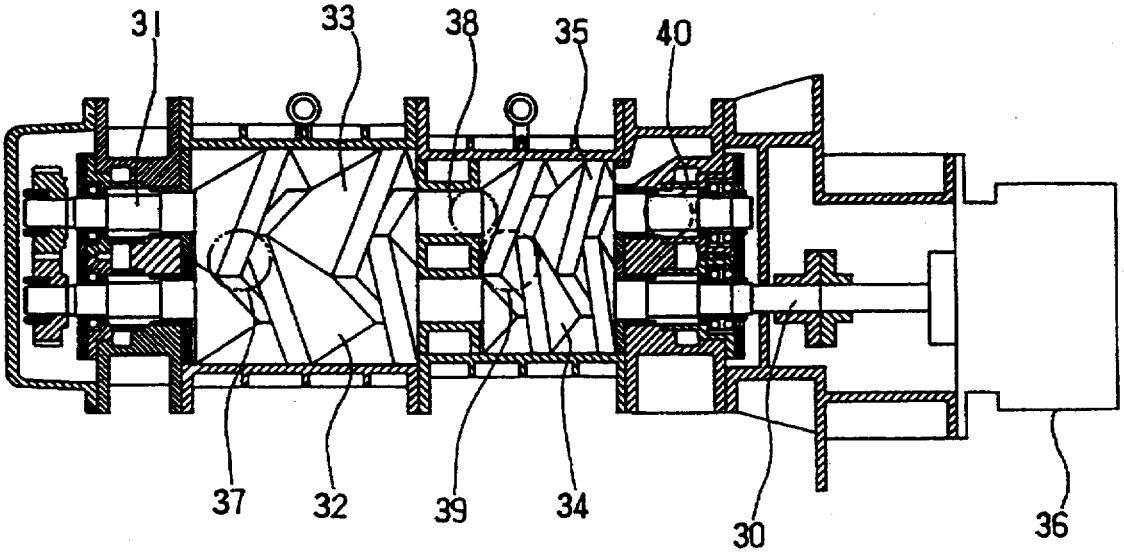
FIG7 (PRIOR ART)
FIG. 7 is a transverse sectional view of a conventional two stage screw vacuum pump.

Referring to FIG. 5 which shows a work/pressure diagram for the pump according to the invention and plotted under the conditions of $C_1>0$, $C_1=0$, and $C_1<0$ respectively.

Work, as expressed under those three conditions, may be interpreted as following ways:

If $C_1$ is zero, the work done has a constant magnitude in spite of changing in pressure.

In the case where $C_1$ has a value less than zero, the work done in the initial pumping stage is presented as a relatively large values. In the meanwhile the zero the pressure is increased, the less work is needed. Thus, under the condition $C_1<0$, the pump may be successfully applicable to the high vacuum range.

Under the third condition, $C_1>0$, the work done is progressively decreased from its initial to its final pumping operation so that the pump can be applicable to a high vacuum range.

With above relations, following interpretations can be presented:

(1) The $\pi_i$ is a function of the work done. Thus, if the $\pi_i$ is to be changed, then the work done can be modified.

(2) If the work done holds constant values from the initial atmospheric pressure range to a final target vacuum range, the $\pi_i$ is $k^{k/(k-1)}$ and $\pi_i$ of air is a value of 3.2. Some modification, however, is required to overcome the flow drag generated in outlet port region of the pump system.

(3) If $\pi_i$ is increased, the work done in the high vacuum range can be maintained in a minimum value.

Accordingly, in order to attain a pump which provides a minimum work done in a high vacuum range, it is necessary to consider the capacity Q of the pump. The capacity Q of the pump is determined using the following equations:

$$Q=\frac{\pi}{4}(D^2-d^2)\cdot L$$

and $$L=\pi\cdot D\cdot\tan\alpha$$

where, Q is a volume of space formed between the adjacent teeth of the screw rotor, D is an outside diameter of the screw rotor, d is an inside diameter of the screw rotor, $\pi$ is the ratio of the circumference of a circle to its diameter, L is a pitch distance of the screw rotor, and $\alpha$ is an angle of the tooth respctively.

With the performance capacity of the pump being denoted by the above relations, It is found that the capacity of the pump is a function of the pitch distance and thus a function of the angle of the teeth of the screw rotor.

The relations set forth above are rewritten as follows:

$$Q_s=\frac{\pi}{4}(D^2-d^2)\cdot\pi\cdot D\cdot\tan\alpha_1$$

and $$Q_d=\frac{\pi}{4}(D^2-d^2)\cdot\pi\cdot D\cdot\tan\alpha_2$$

then it is possible to rewrte above relations as $$\frac{Q_s}{Q_d}=\frac{\tan\alpha_1}{\tan\alpha_2}$$

or $$Q_d=Q_s\frac{\tan\alpha_2}{\tan\alpha_1}$$

where, $Q_s$ is the volume of the space formed between the adjacent teeth at the inlet end, $Q_d$ is the volume of the space formed between the adjacent teeth at the outlet end, $\alpha_1$ is the angle of the tooth at the inlet end, $\alpha_2$ is the angle of the tooth at the outlet end, respectively. In the case the pump of which tooth has a continuous change of pitch along its length, the relation between $Q_d$ and $Q_s$ is generally determined as $Q_d<Q_s$.

As seen by the aforementioned relations, once a compression ratio $\pi_i$ is found, the pitch length can be determined. And the continuous decrease of pitch distance is determinative of a change of tan $\alpha$.

Given values for tan $\alpha$, it will be appreciated from above mentioned relationships that the continuous decrease of pitch distance can be attained.

Given values for $\pi_i$ which is found under the condition of $C_1=0$, it will be appreciated that the value of volume ratio $V_i$ should be more than that of the $\pi_i/k$, the $\pi_i$ being calculated under the condition, $C_1=0$, so that the reduction in power consumption in the high vacuum range can be attained.

It will be appreciated that given the relations established for the preselected condition, the continuous change of the pitch distance is capable of being generated so that the reduction in power consumption, when the pump is operated in the high vacuum ranges, can be attained.

By using a single stage screw rotor, the assembly according to the invention is very simplified so that the space requirement may be reduced as compared to a conventional multi-stage screw displacement pump.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A screw vacuum pump comprising a body defining a chamber, at least one inlet at an inlet end and at least one outlet at an outlet end for the admission of fluid to and discharge of fluid from the chamber, and a pair of intermeshing screw members rotatably mounted within the chamber for transporting the fluid from the inlet end to the outlet end, wherein the pitch of the screw members varies from the inlet end thereof to the outlet end thereof according to the following relation:

$$\text{Pitch at the outlet end/Pitch at the inlet end}<\pi_i/k$$

where, $\pi_i=k^{k/(k-1)}$=pressure ratio calculated under the conditions that the operation is effected in an adiabatic process and the work done is constant, and k is gas constant, and wherein said screw members include a plurality of teeth having a shape of an epitrochoid and archimedean curve, whereby to cause compression of the fluid being delivered.

2. A screw vacuum pump comprising a body defining a chamber, at least one inlet at an inlet end and at least one outlet at an outlet end for the admission of fluid to and discharge of fluid from the chamber, and a pair of intermeshing screw members rotatably mounted within the chamber for transporting the fluid from the inlet end to the outlet end, wherein the pitch of the screw members decreases from the inlet end thereof to the outlet end thereof according to the following relation;

$$\text{Pitch at the outlet end/Pitch at the inlet end}<\pi_i/k$$

where, $\pi_i=k^{k/(k-1)}$=pressure ratio calculated under the conditions that the operation is effected in an adiabatic process and the work done is constant, and k is gas constant, and wherein said screw members include a plurality of teeth having a shape of an epitrochoid and archimedean curve, whereby to cause compression of the fluid being delivered.

* * * * *